US007156266B2

(12) United States Patent
Delage

(10) Patent No.: US 7,156,266 B2
(45) Date of Patent: Jan. 2, 2007

(54) ASSEMBLY FOR PACKAGING AND DISTRIBUTION OF A PRODUCT

(75) Inventor: Jean-François Delage, Clamart (FR)

(73) Assignee: L'Oreal (FR)

( * ) Notice: Subject to any disclaimer, the term of this patent is extended or adjusted under 35 U.S.C. 154(b) by 484 days.

(21) Appl. No.: 10/602,925

(22) Filed: Jun. 24, 2003

(65) Prior Publication Data

US 2004/0050871 A1 Mar. 18, 2004

Related U.S. Application Data

(60) Provisional application No. 60/396,747, filed on Jul. 19, 2002.

(30) Foreign Application Priority Data

Jun. 28, 2002 (FR) ..... 02 08140

(51) Int. Cl.
*B65D 5/72* (2006.01)

(52) U.S. Cl. ..... 222/490; 222/553; 222/482

(58) Field of Classification Search ..... 222/92, 222/206, 212, 490, 548, 553, 556, 559, 522, 222/482; 215/235; 220/252, 256.1, 259.1, 220/259.3, 259.5

See application file for complete search history.

(56) References Cited

U.S. PATENT DOCUMENTS 1,963,766 A * 6/1934 Stewart ..... 222/548
2,858,054 A * 10/1958 Harkrader ..... 222/553
3,094,255 A * 6/1963 Hunter ..... 222/507
3,161,331 A * 12/1964 Murtha ..... 222/402.12
3,278,095 A 10/1966 Johns
3,294,293 A * 12/1966 Johns ..... 222/507
3,371,827 A * 3/1968 Micallef ..... 222/507
4,779,773 A * 10/1988 Bennett ..... 222/507
5,090,601 A * 2/1992 Thanisch ..... 222/507
5,178,613 A * 1/1993 Gibilisco ..... 604/294
6,059,154 A 5/2000 Bigotte et al.

FOREIGN PATENT DOCUMENTS

EP 0 739 826 A1 10/1996
EP 0 764 590 B1 1/2000
EP 0 673 852 B1 2/2000
JP 09124061 5/1997

* cited by examiner

*Primary Examiner*—Philippe Derakshani
(74) *Attorney, Agent, or Firm*—Lerner, David, Littenberg, Krumholz & Mentlik, LLP

(57) ABSTRACT

The present invention relates to an assembly for packaging and distribution of a liquid product comprising a receptacle intended to contain the product, a distribution head fitted to the receptacle, the head comprising at least one nipple with a distribution orifice able to communicate with the interior of the receptacle, a capsule comprising at least one window delimited by an edge extending at least in part in a plane, the capsule being movable in relation to the nipple between a closed position in which the distribution orifice is at least partly opposite a portion of the capsule extending away from the window and an open position in which the distribution orifice is located externally to the capsule, and/or emerges via a flexible membrane fitted to the window via at least one slit.

23 Claims, 8 Drawing Sheets

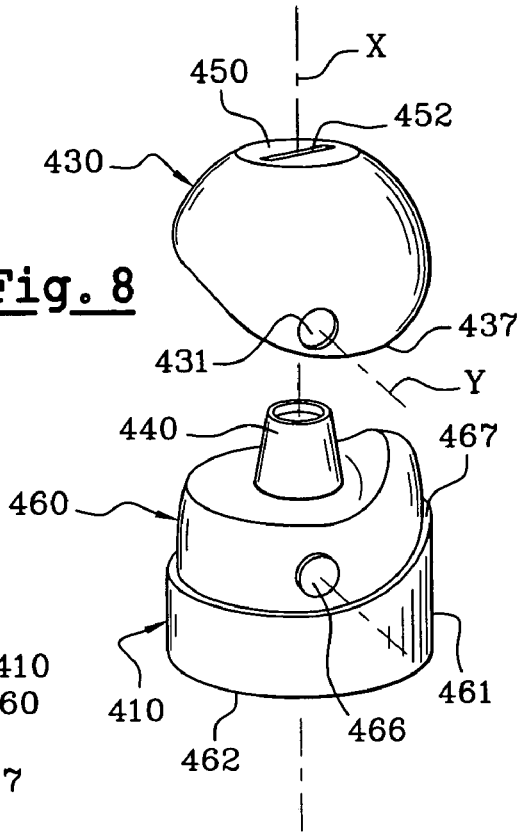
Fig. 8
Fig. 8A
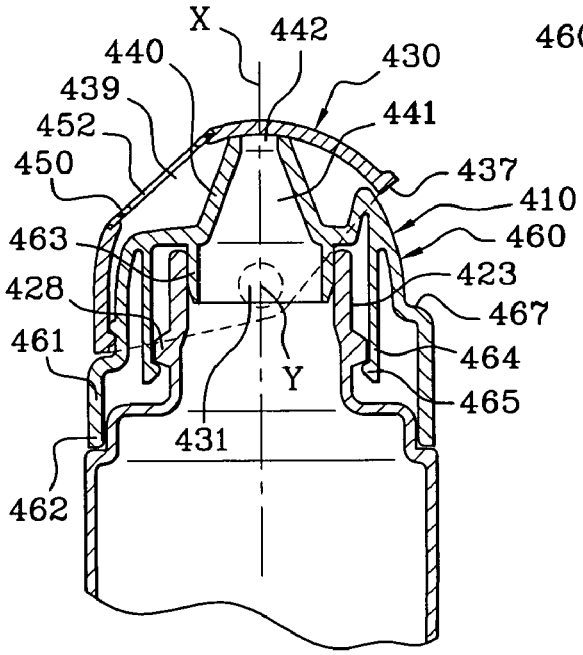
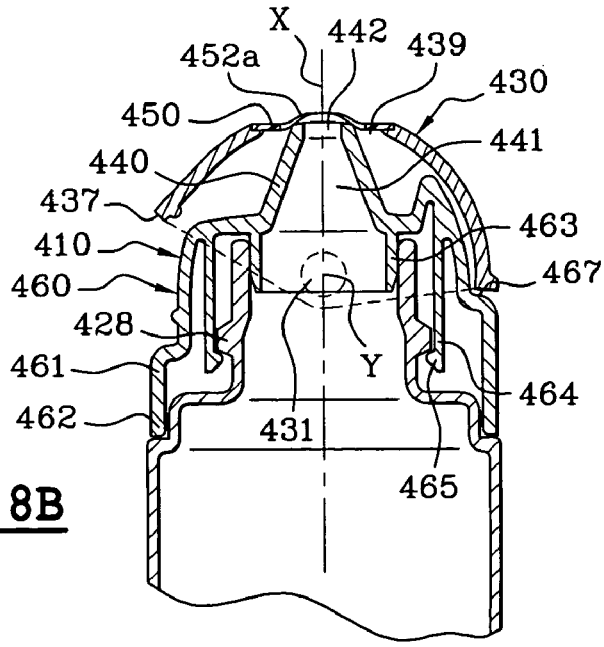
Fig. 8B

ASSEMBLY FOR PACKAGING AND DISTRIBUTION OF A PRODUCT

The present application claims the benefit of the filing date of U.S. Provisional Patent Application No. 60/396,747, filed Jul. 19, 2002, the disclosure of which is hereby incorporated by reference herein.

The present invention relates to an assembly for packaging and distribution of a liquid product, in particular a cosmetic product. The assembly has a distribution orifice that can be closed to preserve the product and open for its distribution.

Assemblies already exist for packaging and distribution comprising a receptacle, containing the product for distribution, topped by a distribution head with a orifice for distribution of the product that communicates with the interior of the receptacle by means of a distribution channel. A flap is provided to close the distribution orifice in the absence of distribution of the product and to open under the effect of the pressure of the product upstream during distribution. Such assemblies have in particular been described in European patents EP 0 673 852 and EP 0 764 590 from the applicant. Such assemblies avoid, on the one hand, discharge of the product during transport and storage and, on the other, the product is protected from impurities coming from the exterior. Furthermore, with such devices, the user can easily distribute, and in a controlled manner, the product contained in the reservoir.

When receptacles with flexible walls are used, these packaging and distribution assemblies, however, have the disadvantage that they do not allow a proper regain of air within the receptacle, due to the fact in particular that the distribution channel is relatively long and thus the distribution orifice is distanced from the interior of the receptacle. The receptacle does not, therefore, regain its initial form after the distribution of the product. Furthermore, the presence of the flap slows the distribution of the product and the air regain.

And so it is one of the objects of the invention to create a packaging and distribution assembly that does not have the disadvantages of the prior art.

It is, in particular, an object of the invention to create a product packaging and distribution assembly that allows easy distribution of the product and that allows air regain in the receptacle immediately after distribution of the product, before closing the orifice.

A further object of the invention is to create a product packaging and distribution assembly which can be closed in such a way as to prevent any untimely flow of the product in the closed position.

Also, a further object of the invention is to create a product packaging and distribution assembly that is simple to use, in particular that can easily move from a closed position to a distribution position.

According to the invention, these objects are achieved by creating a liquid product packaging and distribution assembly comprising:

- a receptacle, intended to contain the product;
- a distribution head, fitted to the receptacle, comprising at least one nipple fitted with a distribution orifice able to communicate with the interior of the receptacle;
- a capsule comprising at least one window delimited by an edge extending at least in one plane;
- the capsule being movable in relation to the nipple between a closed position in which the distribution orifice is at least partly opposite a portion of the capsule extending away from the window and an open position in which the distribution opening
  - i) is located externally to the capsule, at a distance not equal to zero from said plane, and/or
  - ii) emerges through a flexible membrane fitted to said window, via at least one slit.

So, in order to distribute the product, the capsule is first positioned in relation to the nipple in such a way as to free at least in part the distribution orifice so that when the product reaches the level of the orifice this is already open. The product can therefore leave immediately without being slowed down by the presence of a closing flap and the air can then enter the receptacle via the orifice without any obstacle. Furthermore, by choosing a relatively small nipple, the length of passage between the distribution orifice and the interior of the receptacle is limited in such a way as to facilitate the regain of air inside the receptacle.

When a flexible membrane is used, it can, for example, be created from an elastically deformable material, in particular an elastomer. The elastomer material is, for example, chosen from the group of elastomers comprising propylene/ethylene copolymers; blocamide polyethers; polyvinyls; ethylene, propylene and diene (EPDM) terpolymers; styrene-butadiene sequenced (SBS) polymers; styrene-ethylene-butadiene sequenced (SEBS-SIS) polymers; thermoplastic polyurethanes; mixtures of polypropylene and one of the following elastomers: styrene-ethylene-butadiene sequenced (SEBS-SIS) polymers; ethylene, propylene and diene (EPDM) terpolymers; styrene-butadiene (SBS) sequenced polymers. Due to the elasticity of the material forming the membrane, the slit can easily open when the nipple engages with it and can therefore easily free the distribution opening.

Alternatively, the membrane can also be created from a fine layer of polyolefin which allows it to be flexible.

According to one embodiment, the membrane is, by way of example, obtained by moulding starting with a single piece with the capsule, in particular by bi-injection. The membrane has, for example, the shape of a disc or also an annular membrane.

According to another embodiment, the membrane can also be an attached part fixed to the capsule, in particular by gluing, clamping, welding or riveting.

The slot can be fully delimited by the membrane and obtained directly during moulding of the membrane or can also be obtained by drilling of said membrane. Alternatively, it can be partly delimited by the membrane and partly by the capsule.

Advantageously, the slit is delimited by the edges that are more or less butt-jointed in the closed position. So, as soon as the nipple comes into contact with the membrane and deforms it, the slot opens immediately.

The capsule can be mobile in translation in relation to the nipple. Alternatively, the capsule can be mobile in rotation in relation to the nipple.

According to a particular embodiment, the assembly comprises at least two nipples, each having a distribution orifice with a different cross-section. In this way, a distribution assembly is obtained in which the product can be distributed with two different delivery rates.

Advantageously, in the closed position, the nipple comes to rest on an internal surface of the capsule so that said surface closes off the distribution orifice in a sealed manner to the product. So, the product remaining in the nipple following use does not dry out and does not risk closing off the distribution orifice over time.

More advantageously, the capsule comprises a sealing member provided so that in the closed position it interrupts the communication between the distribution orifice and the interior of the receptacle. In this way, any untimely flow of product in the closed position is avoided.

According to a particular embodiment, the receptacle terminates in an open neck on which the distribution head is mounted, in particular be screwing or snap-fastening. Alternatively, the receptacle terminates in an open neck in which the nipple is formed.

The receptacle is, for example, a tube or a bottle which comprises a deformable wall. Alternatively, the receptacle can be formed by a non-deformable wall, the assembly then having a pump or any other distribution device.

The invention is particularly useful for the packaging and distribution of a cosmetic product, in particular a care product or a hair product.

The invention comprises, apart from the arrangements set out above, a number of other arrangements that will be explained below, in relation to non-restrictive embodiments described by reference to the annexed figures, in which:

FIG. 8 shows an exploded view of a fifth embodiment of the assembly according to the invention;

FIG. 8A shows a longitudinal cutaway drawing of the fifth embodiment of the assembly according to the invention, in the closed position;

FIG. 8B shows a longitudinal cutaway drawing of the fifth embodiment of the assembly according to the invention, in the distribution position;

Figure 1:
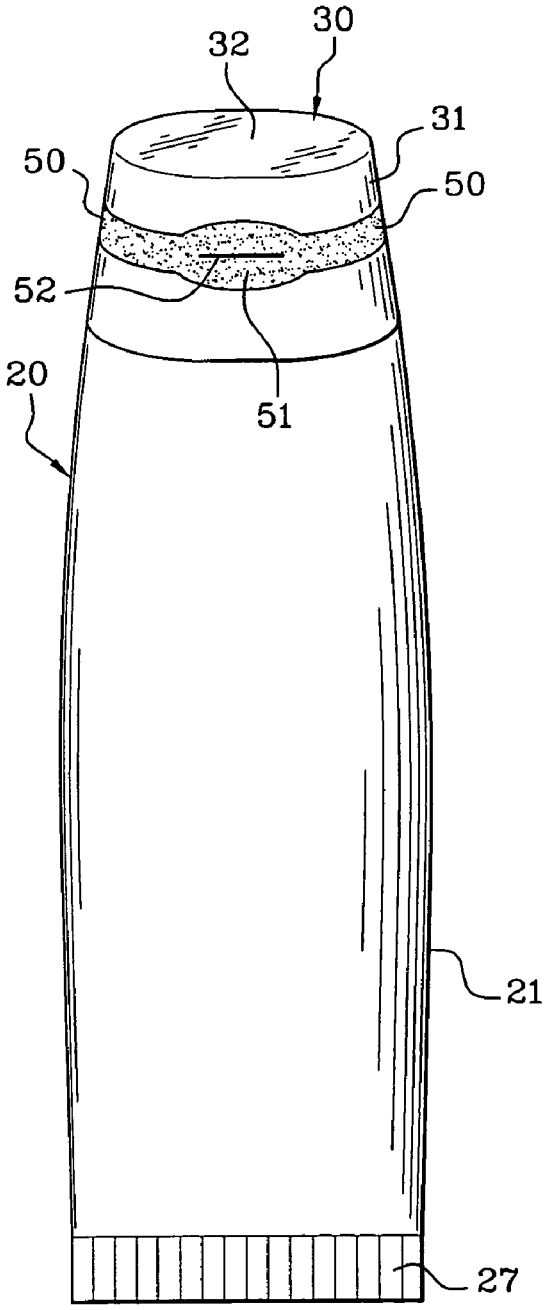
FIG. 1 shows a perspective view of a first embodiment of a packaging and distribution assembly according to the invention, in the closed position.
Figure 2:
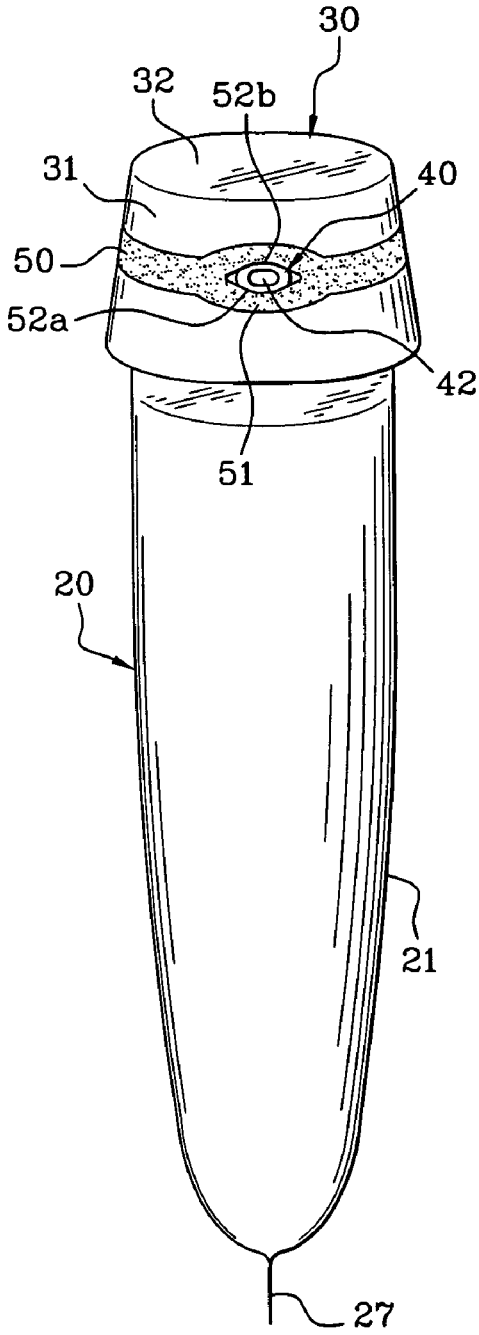
FIG. 2 shows a perspective view of the first embodiment of the packaging and distribution assembly in the distribution position.

FIGS. 1 to 4B show a first embodiment of a packaging and distribution assembly that comprises a receptacle 20 in the form of a tube topped by a distribution head 10 that can be closed by a closing capsule 30. The tube 20 contains a liquid product, for example a creme or paste, intended to be applied to a surface to be treated. This could, for example, be a sun cream.

The tube 20 comprises a body 21 with axis X, more or less cylindrical in its upper portion and more or less oval in its transversal cross-section. The upper portion of the body 21 is connected to a shoulder 22, which shoulder is topped by a neck 23. Opposite the neck 23, the tube 20 is closed by a rectilinear base 27, according to a line of closure obtained by pinching and heat sealing of the bottom end of the body 21.

The tube 20 is flexible, that is to say it is compressible in the area of the body 21, while the shoulder and the neck are more or less rigid, due to a greater thickness of their material in relation to the thickness of the material forming the body 21. The difference in rigidity between the body and the neck (or the shoulder) can also be the result of the choice of material type when a complex tube in two different materials is created. The tube is preferably created from polyethylene or another similar thermoplastic material in order to form a deformable wall that can revert to its initial position when released. Alternatively, it can be created from aluminium or tin. In the latter case, the base is obtained by folding the bottom end of the body. The body 21, as appropriate, can be created by a multi-layer structure, for example plastic/metal/plastic.

The neck 23 of the tube is traversed by a central distribution channel 25 with axis X, in communication with the interior of the tube, and which opens out in its top part via an opening 26. The distribution head 10 is formed by a nipple 40 created in the wall of the neck 23, according to an axis that is perpendicular to axis X, and projects beyond the wall of the neck towards the exterior. The nipple 40 is traversed by a conduit 41 one end of which 43 opens out into the central channel 25 of the neck and the other opens out via a distribution orifice 42 towards the exterior. The neck 23 also has a snap-fit flange 24 allowing the closing capsule 30 to be secured.

The closing capsule 30 is mounted on the tube in such a way as to be mobile in rotation around the axis X. The capsule 30 is formed by an external wall comprising a lateral wall 31 of more or less oval transversal cross-section which is not completely symmetrical, as will be seen in a more detailed manner later on. The transversal cross-section of the capsule reduces progressively from its bottom end which is open, as far as its top end which is closed by a transversal wall 32. The capsule is, for example, created from polythene or another similar thermoplastic material.

A window 39 is formed in the lateral wall 31 of the capsule 30 and is delimited by an edge of the capsule that extends according to a plane P parallel to the major axis of the oval transversal cross-section. At the axial level of the window, the capsule is not completely symmetrical. In fact, the portion of the wall 31 comprising the window is more or less flatter than the diametrically opposed portion of the wall which is convex towards the exterior, that is to say that the plane in which the window extends is closer to the axis X than the portion of the wall 31 that is diametrically opposed to said window. The window 39 is closed by a portion 51 of an elastomer membrane 50, for example created from SEBS.

The membrane 50 is annular in shape and surrounds the remainder of the lateral wall 31 at the height of the window. The membrane is, for example, welded to the lateral wall 31. The portion 51 of the membrane thus extends according to the plane P parallel to the major axis of the oval cross-section. The portion 51 of the membrane comprises a slit 52 delimited by two edges 52*a* and 52*b*. In the rest position, namely when the membrane is not stressed, the two edges 52*a* and 52*b* are butt-jointed. When the capsule is mounted on the tube, the slit 52 is arranged at the same axial height according to the axis X as the nipple 40.

Two locking tabs 33 extend into the interior of the capsule 30 parallel to the axis X from the transversal wall 32 as far as a free edge. The two tabs have a cord 35 in order to lock onto the snap-fit flange 24 of the neck in order to keep the capsule 30 in position on the tube 20. Each tab 33 is formed by a concave wall arranged close to each end of the major axis of the oval cross-section, the two tabs having their concave faces turned towards each other. The tabs are configured and arranged in such a way that the end of the nipple 40 comes into sealed contact with the concave portion of a tab in the closed position of the distribution device.

A sealing skirt 34 is also provided in the interior of the capsule 30 to insert in the opening 26 of the neck 23 of the tube 20 and to come into sealed contact with the interior surface of the neck. The sealing skirt 34 is a cylindrical skirt that extends parallel to the axis X from the transversal wall 32 as far as a free edge. The sealing skirt also has a length, according to the axis X, that is sufficient to close off the end 43 of the conduit 41 traversing the nipple. An opening 36 is formed in a small angular portion of the sealing skirt, opposite the slit 52. In the open position of the distribution assembly, the opening 36 is opposite the end 43 of the conduit 41 traversing the nipple 40 in such a way as to allow the conduit 41 to communicate with the interior of the tube via the passage 25 traversing the neck.

Figure 3A:
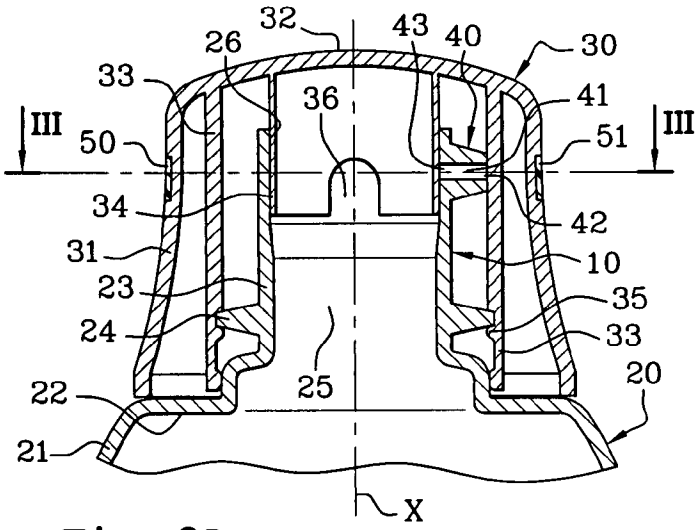
FIG. 3A shows a longitudinal cutaway drawing of the assembly shown in FIG. 1.
Figure 3B:
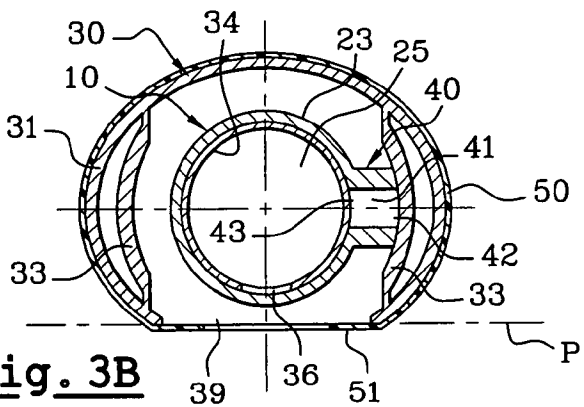
FIG. 3B shows a cutaway drawing according to plane III—III of the assembly shown in FIG. 3A.

In the closed position shown in FIGS. 3A and 3B, it can be seen that one of the locking tabs 33 comes to rest in a sealed manner on the distribution orifice 42. The tab 33 also, therefore, performs the task of a means of closing and prevents the product that may remain in the nipple following use from drying. In this position, the sealing skirt 34 closes off the end 42 of the conduit traversing the nipple, in such a way that it interrupts the communication between the interior of the receptacle and the distribution orifice, thereby avoiding any untimely flow of the product.

Figure 4A:
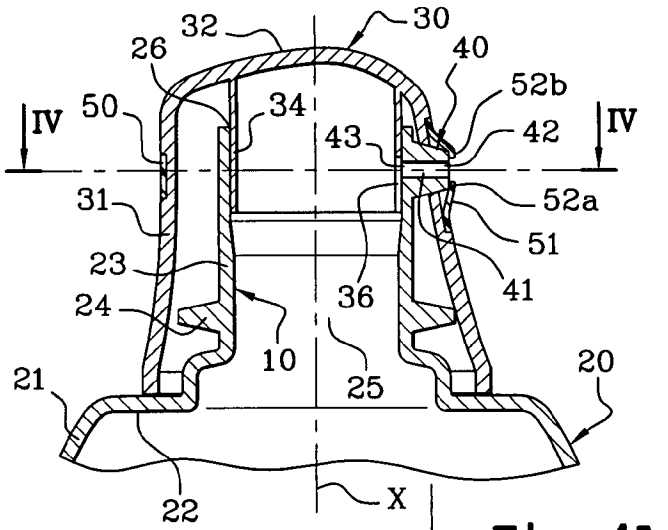
FIG. 4A shows a longitudinal cutaway drawing of the assembly shown in FIG. 2.
Figure 4B:
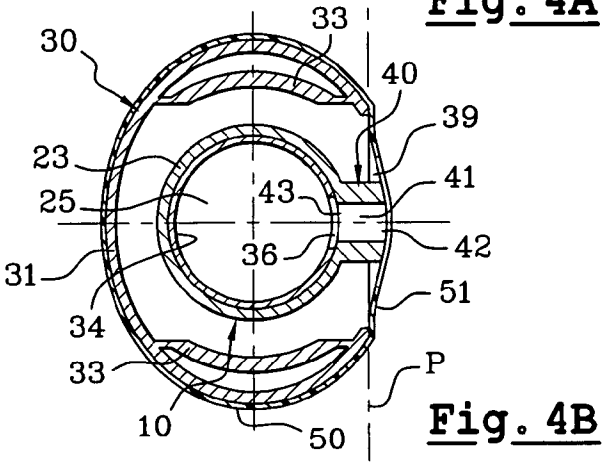
FIG. 4B shows a cutaway drawing according to plane IV—IV of the assembly shown in FIG. 4A.

In order to distribute the product, the user turns the capsule 30 by 90° around the axis X in such a way as to free the distribution orifice 42, as shown in FIGS. 4A and 4B. In this position, the nipple 40 projects beyond the plane P, as a result of its non-symmetrical form, parting the edges 52*a* and 52*b* of the slit 52. The distribution orifice 42 thereby opens out from the capsule. As the slit is formed from an elastomer material, the edges 52*a* and 52*b* part easily from one another due to the elasticity of the material, such that it is easy to move from the closed position to the distribution position. In this position, the opening 36 formed in the sealing skirt is opposite the end 43 of the conduit traversing the nipple so that the distribution orifice is in communication with the product contained in the tube via the conduit 41 and the channel 25. The user can then press the walls of the tube in order to reduce the interior volume of this and create an over-pressure inside the tube which pushes the product towards the distribution orifice. When he releases the walls of the tube, air is aspirated to the interior of this via the distribution orifice 42 and the conduit 41. The walls of the tube then regain their initial shape.

In the embodiments that follow, the elements corresponding to those of the embodiment that has just been described have a numerical reference that has been incremented by one hundred.

Figure 5A:
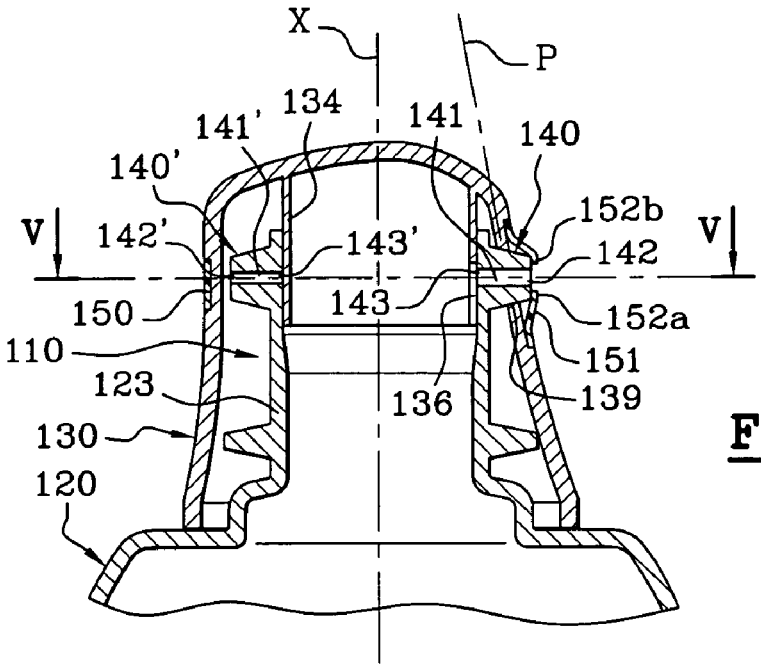
FIG. 5A shows a longitudinal cutaway drawing of a second embodiment of the assembly according to the invention in the distribution position.
Figure 5B:
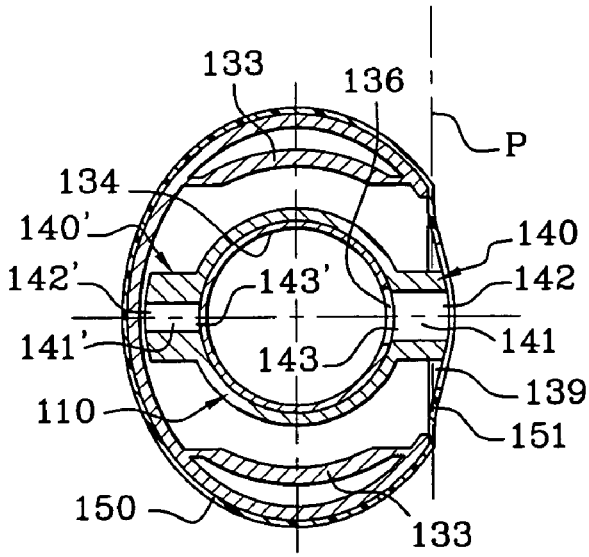
FIG. 5B shows a cutaway drawing according to plane V—V of the second embodiment shown in FIG. 5A.

FIGS. 5A and 5B show a second embodiment of a packaging and distribution assembly according to the invention which differs from the first example that has just been described in that this time it has two distribution nipples 140, 140', with the capsule 130 having a single window 139, formed in a plane P, closed by a membrane 150. According to this embodiment, the neck 123 of the bottle 120 comprises two projecting nipples 140 and 140' that are diametrically opposed on the neck. Each nipple 140, 140' is traversed by a conduit 141, 141' which opens out at the end of the nipple via a distribution orifice 142, 142'. The two conduits 141 and 141' and the two orifices 142 and 142' have different sized cross-sections in order to deliver the product at different rates. As can be seen from FIGS. 5A and 5B, when the nipple 140 separates the edges 152*a* and 152*b* of the slit 152, the opening 136 provided in the sealing skirt 134 is positioned opposite the end 143 of the conduit in such a way that the distribution orifice 142 communicates with the product inside the tube. In this position, the end 143' of the conduit 141' traversing the second nipple 140' is closed off by the sealing skirt 134 such that the product leaving the tube cannot access this conduit 141'. To distribute the product at a lower rate, the user turns the capsule 130 by 180°, around the axis X, in such a way as to position the second nipple 140' through the slit 150 and position the opening 136 of the sealing skirt opposite the end 143' of the conduit 141'. In the closed position, which is not shown, the end of each nipple 140 and 140' comes into sealed contact with the concave portion of each locking tab 133.

Figure 6:
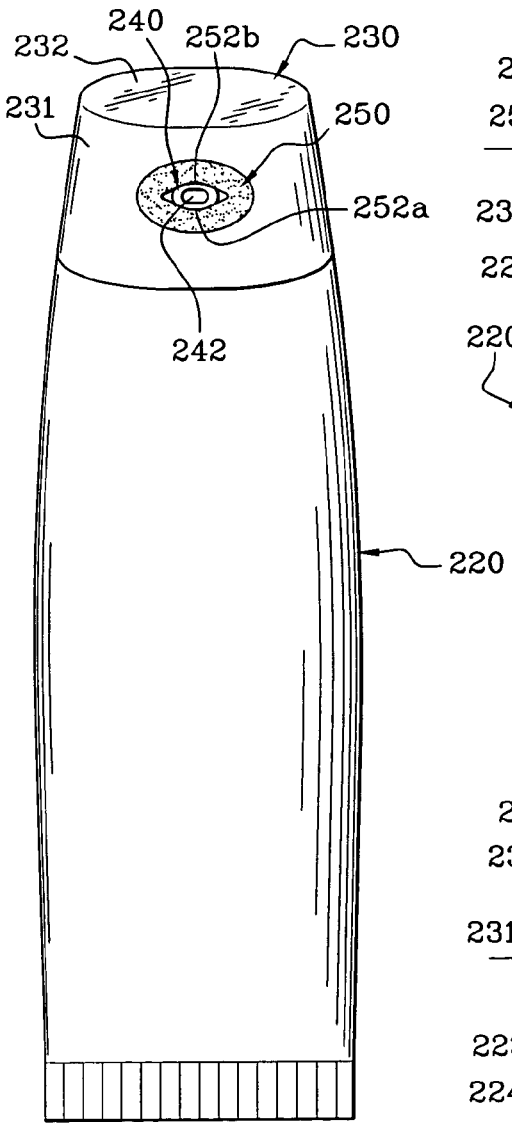
FIG. 6 shows a perspective view of a third embodiment of a packaging and distribution assembly according to the invention, in the distribution position.
Figure 6A:
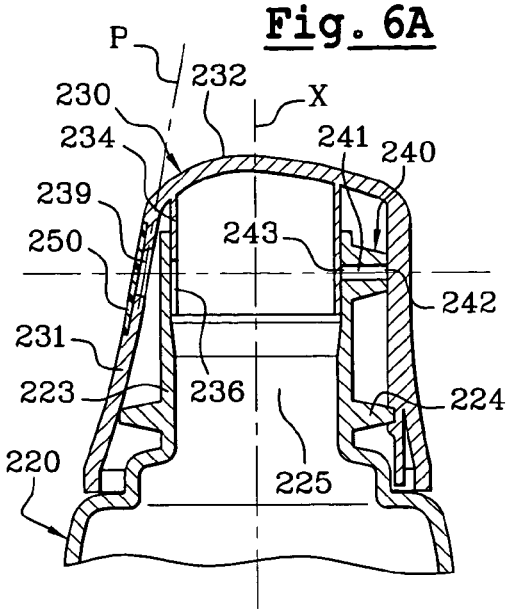
FIG. 6A shows a longitudinal cutaway drawing of the third embodiment, in the closed position.
Figure 6B:
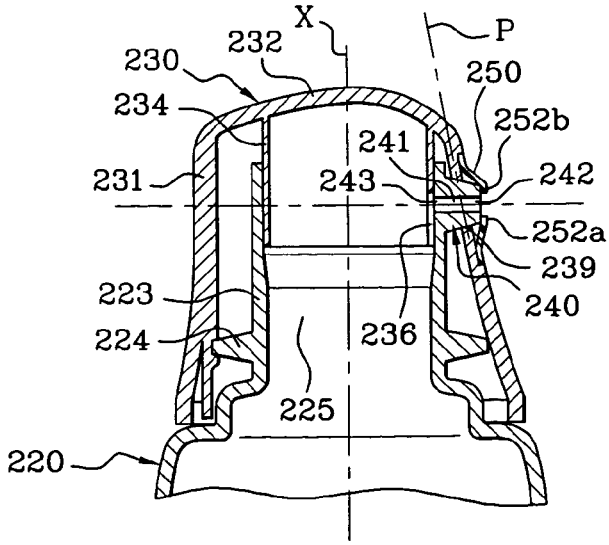
FIG. 6B shows a longitudinal cutaway drawing of the third embodiment, in the distribution position.

FIGS. 6 to 6B show a third embodiment of a packaging and distribution assembly according to the invention that differs from the first example described according to FIGS. 1 to 4B by its closing capsule.

The closing capsule 230 is mounted on the tube 220 in such a way as to be mobile in rotation around the axis X. The capsule 230 is formed by an exterior wall, identical to that which has just been described, which comprises a lateral wall 231 closed in its top part by a transversal wall 232. A sealing skirt 234, identical to that described in the first embodiment, has an opening 236. The annular membrane 50 is replaced by a membrane 250 in the form of an oval disc which covers only the window 239 formed in the lateral window of the capsule, according to a plane P. The disc 250 is, for example created by bi-injection.

In the closed position shown in FIG. 6A, the distribution nipple 240 this time comes into sealed contact with a portion of the internal surface of the lateral wall 231 of the capsule 230 positioned diametrically opposed to the disc 250. In order to place the capsule in the distribution position, the user this time turns the capsule 230 by 180° around the axis X so that the nipple traverses the window 239 so that the distribution orifice 242 is located externally to the capsule away from plane P, and emerges through the membrane. The distribution orifice 242 is then freed as shown in FIG. 6B.

Figure 7A:
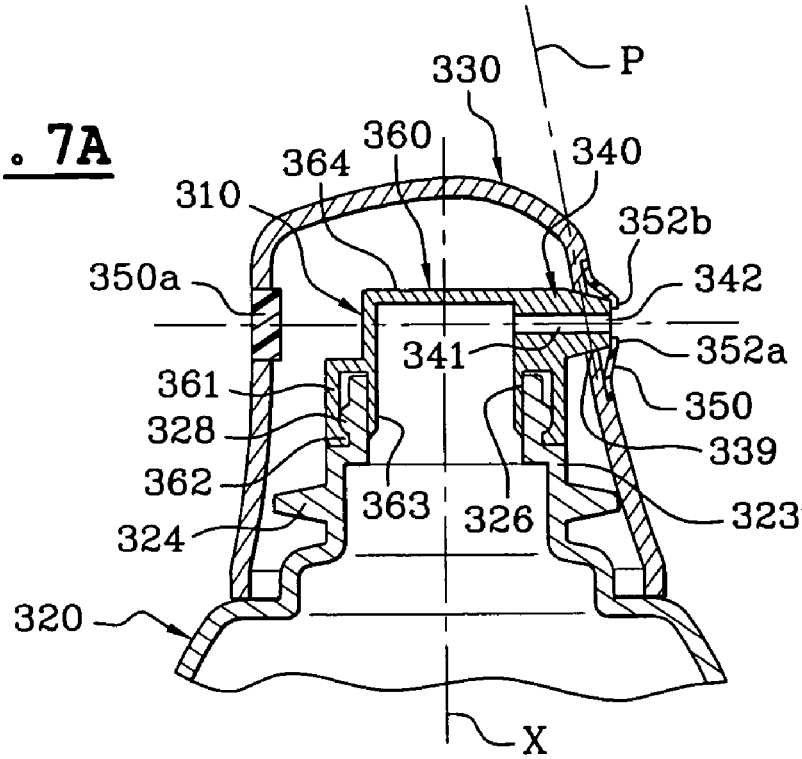
FIG. 7A shows a longitudinal cutaway drawing of a fourth embodiment of the assembly according to the invention, in the distribution position.
Figure 7B:
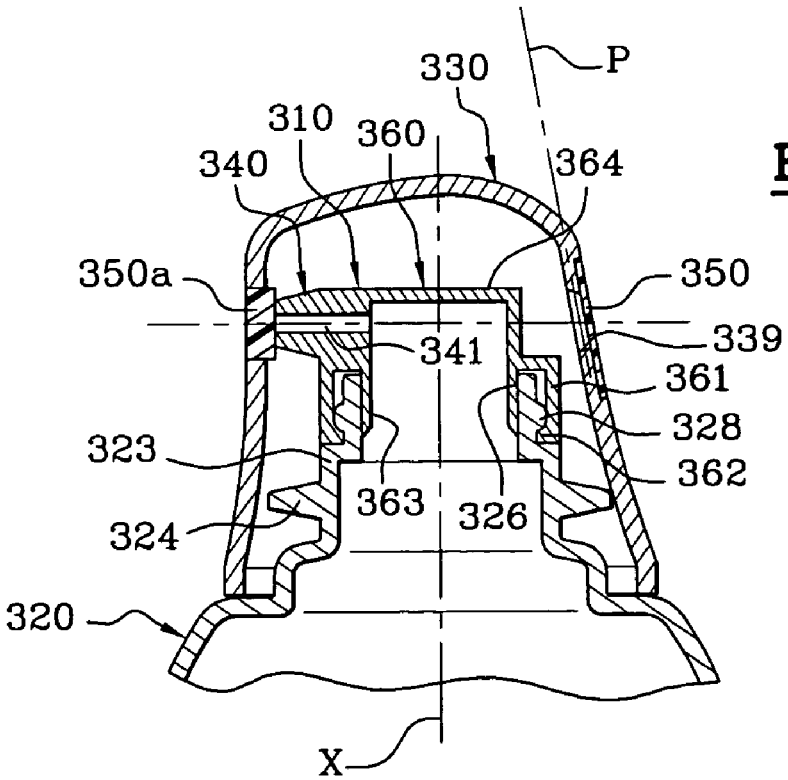
FIG. 7B shows a longitudinal cutaway drawing of the fourth embodiment in the closed position.

FIGS. 7A and 7B show a fourth embodiment of a packaging and distribution assembly according to the invention. In this example, the distribution nipple is not created directly on the neck of the tube but on an attached part. The distribution nipple 340 is created on a reducer 360 that is mounted on the neck 323 of the tube by snap-fastening. The external wall of the neck 323 has a second snap-fit flange 328 formed between the first flange 324, serving to hold the capsule 330, and the opening 326 of the neck. The reducer 360 comprises an axial mounting skirt 361, the internal wall of which terminates at its bottom end by an annular cord 362 provided to cooperate with the second snap-fit flange 328. The reducer 360 also comprises a sealing skirt 363, concentric with the mounting skirt 361, provided to be inserted in the neck 323 of the tube and to come into sealed contact with the internal surface of this. The sealing skirt 363 is extended axially at its top end by a wall which is closed by a transversal wall 364. The distribution nipple 340 extends perpendicularly to the sealing skirt from its top end. The nipple has a conduit 341 which is in permanent communication with the interior of the tube.

According to this embodiment, the capsule 330 comprises a window 339, extending in a plane P, closed by an annular elastomer membrane 350 which extends over the entire periphery of the capsule, said membrane having been created, for example, by bi-injection. The portion of the membrane closing the window is traversed by a slit 352. Opposite the slit, the lateral wall 331 of the capsule is formed solely by a portion 350*a* of the elastomer membrane. Thus, in the closed position shown in FIG. 7B, the end of the nipple 340 comes to rest on the portion of membrane 350*a*. The portion 350*a* of the membrane is advantageously thicker than the rest of the membrane so that it forms a sealing joint that perfectly closes off the distribution orifice 342 in the closed position.

FIGS. 8, 8A and 8B show a fifth embodiment of a packaging and distribution assembly according to the invention, in which the distribution nipple is created on a reducer that is fixed to the tube. According to this example, the closing capsule 430 is mounted on the reducer in order to be able to pivot around an axis Y perpendicular to the axis X.

The external wall of the neck 423 this time has a single snap-fit flange 428 used for fixing the reducer 460 by snap-fastening, the capsule 430 this time being fixed to the reducer 460.

The reducer 460 is formed by a lateral wall 461 open at its bottom end 462 so that it fits on to the top part of the receptacle, and extends in its top part via a tapered wall forming a distribution nipple 440 of axis X. The tapered wall delimits a conduit 441, in permanent communication with the interior of the tube, which opens out on a distribution orifice 442 also of axis X. The lateral wall 461 comprises a small shoulder 467 over its entire periphery, which will serve, as will be seen later, as a limit stop for the capsule. A cylindrical sealing skirt 463 is formed around the inlet to the conduit 441 and extends parallel to the axis X. The sealing skirt 463 is provided to be inserted in the neck 423 coming into sealed contact with the internal wall of the neck in order to ensure sealed communication between the interior of the receptacle and the distribution orifice. The reducer 460 also comprises a fixing skirt 464 which extends parallel to the axis X, around the sealing skirt 463. The fixing skirt 464 is also a cylindrical skirt which comprises an annular cord 465 at its free end, provided to cooperate with the snap-fit flange 428 for fixing the reducer. Two projections 466 of circular cross-section are formed in a diametrically opposed manner on the external surface of the lateral wall 461 of the reducer. The projections are provided to cooperate with the two orifices 431 formed on the closing capsule 430.

The closing capsule 430 is formed by a more or less hemispherical wall mounted on the reducer in such a way as to be mobile in rotation around an axis Y, perpendicular to axis X. To this end, two orifices 431 of circular cross-section are provided in the hemispheric wall which receive the two projections 466 of the reducer. The capsule covers the distribution nipple and the part of the lateral wall 461 situated between the nipple and the shoulder 467 against which it stops. The bottom free edge 437 of the capsule 430 and the shoulder 467 are configured in such a way as to allow the swinging movement of the capsule between the closed position shown in FIG. 8A in which the capsule stops against a first part of the shoulder and the distribution position shown in FIG. 8B in which the capsule stops against a second part of the shoulder 467. A window 439 is formed in the hemispherical wall 430 and is closed by an elastomer membrane 450, for example in SEBS. This membrane 450 is obtained by over-moulding the elastomer material. The membrane 450 comprises a slit 452 delimited by two edges 452*a* and 452*b* that are more or less butt-jointed when at rest, that is when the membrane is not stressed.

In a first position of the capsule shown in FIG. 8A, the end of the nipple comes to rest in a sealed manner on the internal surface of the capsule. In this position, the distribution orifice 442 is therefore closed in a sealed manner. Advantageously, provision can be made for at least part of the interior surface of the capsule to be covered by an elastomer material, formed, for example, in the extension to the membrane, such that the orifice is perfectly closed by the elastomer layer that forms a sealing joint.

To distribute the product, the user swings the capsule around the axis Y so that the membrane comes into the axis of the distribution orifice, as shown in FIG. 8B. In this position, the nipple 440 separates the edges 452*a* and 452*b* of the slit 452 so that the distribution orifice 442 opens out from the capsule and is open.

Figure 9A:
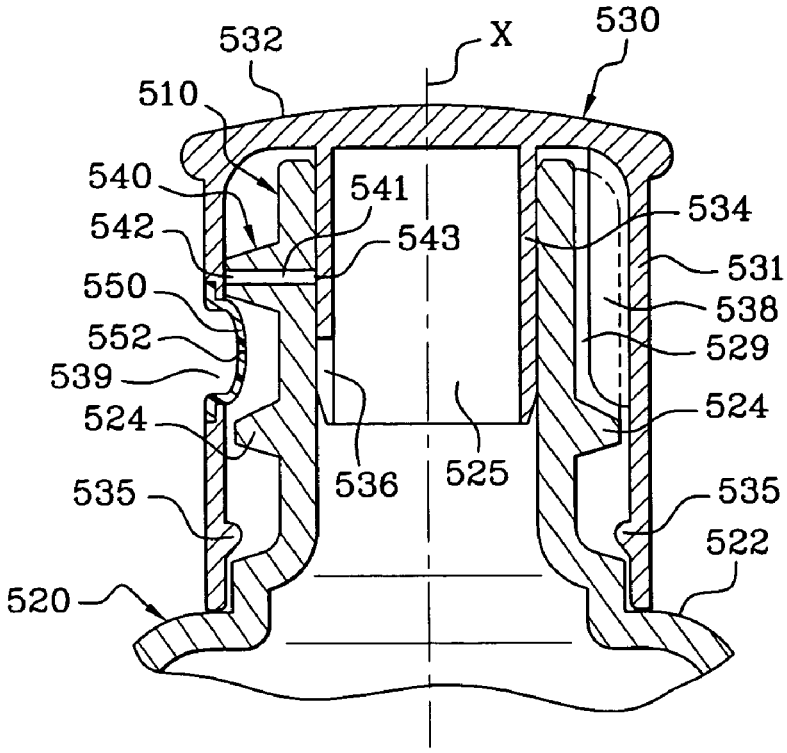
FIG. 9A shows a longitudinal cutaway drawing of a sixth embodiment of the assembly according to the invention in the closed position.
Figure 9B:
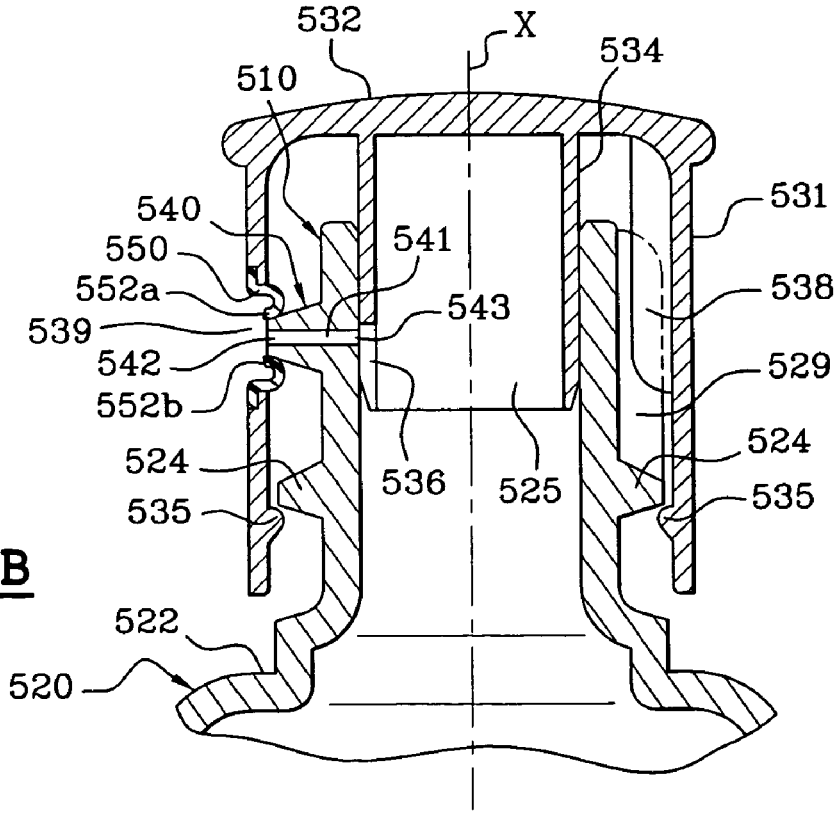
FIG. 9B shows a longitudinal cutaway drawing of the sixth embodiment of the assembly according to the invention, in the distribution position.

The embodiment shown in FIGS. 9A and 9B differs from the first example shown according to FIGS. 1 to 4B principally by its closing capsule 530. According to this embodiment, the capsule 530 is mounted on the tube so that it is mobile in translation according to axis X. The neck of the tube 520 has an axial guiding groove 529 which extends, parallel to the axis X, between the snap-fit flange 524, that serves to hold the capsule on the neck, and the opening of the neck. The capsule 530 also comprises a lateral wall 531 that extends parallel to the axis X from an open bottom end to a closed top end via a transversal wall 532. The lateral wall 531 has a constant circular transversal cross-section throughout its axial height. A guiding rib 538 is formed on the internal surface of the lateral wall 531 in order to slide in the groove 529. An annual cord 535 is provided on the internal surface of the lateral wall 531 in order to come to a stop against the snap-fit flange 524 in order to maintain the capsule on the neck. A sealing skirt 534 identical to that of the first example extends parallel to the axis X from the transversal wall 532 as far as a free edge. The lateral wall 531 comprises a window 539 closed by an elastomer membrane 550 traversed by a slit 552. When the membrane is not stressed, it has a shape that is convex towards the interior of the capsule so that it projects over the interior surface of the lateral wall 531, towards the interior of this. In this position, the slit is closed, that is to say edges 552*a* and 552*b* which delimit it are more or less butt-jointed.

In the closed position shown in FIG. 9A, the capsule is pushed onto the tube. The sealing skirt 534 then closes off the end 543 of the conduit 541 traversing the nipple 540. In this position, the nipple 540 comes almost into contact with the internal surface of the lateral wall 531, above the membrane 550. The membrane 550 is not stressed by the nipple so the slit 552 is closed.

In order to move from the closed position to the distribution position shown in FIG. 9B, the user displaces the capsule axially, moving it away from the tube. The rib 538 slides in the groove 529 until the annular cord 535 comes to a stop against the snap-fit flange 524. In this position, the opening 536 formed in the sealing skirt 534 is opposite the end 543 of the conduit traversing the nipple 540 so that the distribution orifice 542 is in communication with the product contained in the tube via the conduit 541 and the channel 525. The nipple 540 is then at the axial height of the membrane 550 on which it applied pressure and traverses the slit 552 so that it frees the distribution orifice 542.

Figure 10:
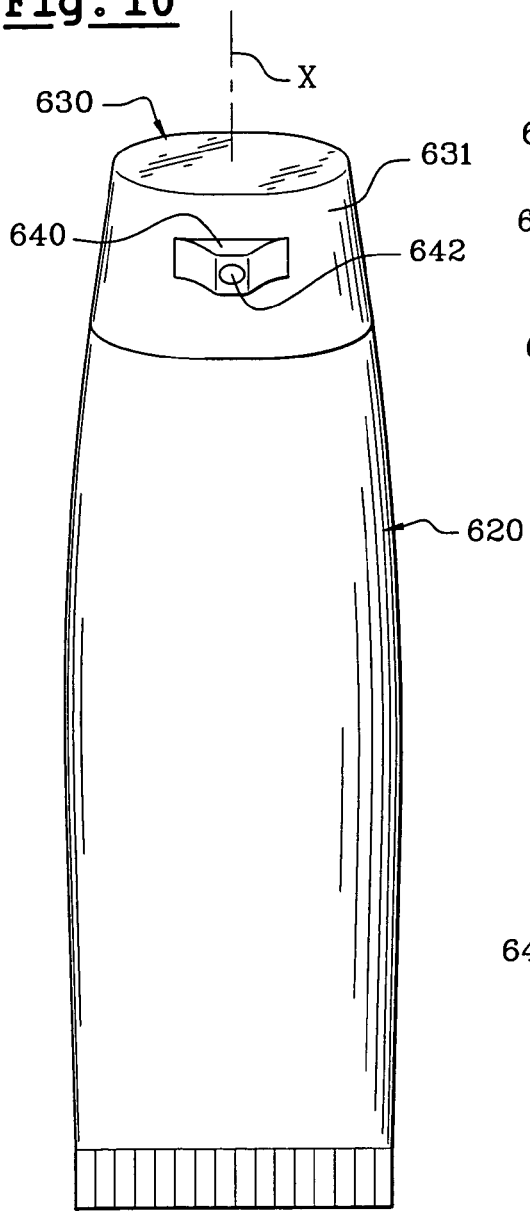
FIG. 10 shows a perspective view of a seventh embodiment of a packaging and distribution assembly according to the invention, in the distribution position.
Figure 10A:
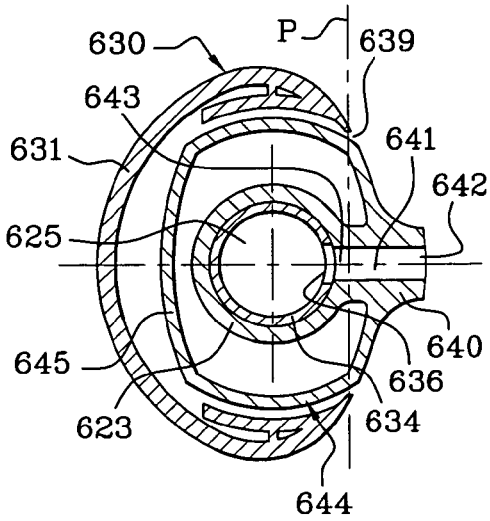
FIG. 10A shows a transversal cutaway drawing of FIG. 10.
Figure 10B:
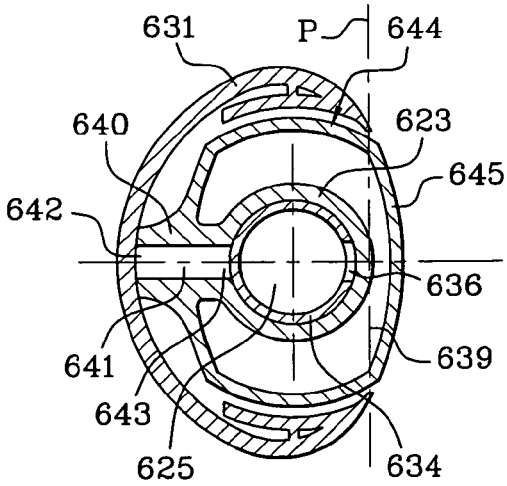
FIG. 10B shows a transversal cutaway drawing of the seventh embodiment in the closed position.

FIGS. 10 to 10B show a variant in which the lateral wall 631 of the closing capsule 630 comprises a window 639, delimited by an edge extending according to a plane P which is not closed by a membrane.

According to this embodiment, the nipple 640 is created in the neck 623 of the tube and is extended by a ring 644 that surrounds the neck 623. The ring 644 is of a more or less rectangular transversal cross-section with sides that are more or less convex towards the exterior. The ring 644 comprises a portion 645, arranged opposite the nipple, provided to close off the window 639 in the closed position as shown in FIG. 10B.

In the distribution position as shown in FIG. 10A, the nipple 640 traverses the window 639 of the capsule so that the distribution orifice 642 is on the exterior of the capsule, at a distance from plane P in which the window 639 extends. To move to the closed position shown in FIG. 10B, the user turns the capsule 630 by 180° around the axis X, in order to position the end of the nipple 640 in sealed contact with the interior surface of the lateral wall 631 of the capsule 630. In this position, the window 639 is closed off by the portion 645 of the ring that projects into plane P.

In the above detailed description, reference has been made to preferred embodiments of the invention. It is clear that variations may be made to these without deviating from the spirit of the invention as claimed below.

The invention claimed is:

1. An assembly for packaging and distribution of a liquid product comprising:

a receptacle intended to contain the product;

a distribution head fitted to the receptacle, comprising at least one nipple with a distribution orifice able to communicate with the interior of the receptacle;

a capsule comprising at least one window delimited by an edge extending at least in part in a plane;

the capsule being movable in relation to the nipple between a closed position in which the distribution orifice is at least partly opposite a portion of the capsule extending away from the window and an open position in which the distribution orifice emerges via a flexible membrane fitted to the window, via at least one slit.

2. The assembly according to claim 1, wherein the flexible membrane is created from an elastically deformable material.

3. The assembly according to claim 2, wherein the elastomer material is chosen from the group of elastomers consisting of propylene/ethylene copolymers; blocamide polyethers; polyvinyls; ethylene, propylene and diene terpolymers; styrene-butadiene sequenced polymers; styrene-ethylene-butadiene sequenced polymers; thermoplastic polyurethanes; mixtures of polypropylene and one of the following elastomers: styrene-ethylene-butadiene sequenced polymers; ethylene, propylene and diene terpolymers; and styrene-butadiene sequenced polymers.

4. The assembly according to claim 1, wherein the membrane is obtained by molding starting with the capsule.

5. The assembly according to claim 1, wherein the membrane is an attached part fixed to the capsule.

6. The assembly according to claim 1, wherein the slit is delimited by edges that are generally butt-jointed in the closed position.

7. The assembly according to claim 1, wherein the capsule is mobile in translation in relation to the nipple.

8. The assembly according to claim 1, wherein the capsule is mobile in rotation in relation to the nipple.

9. The assembly according to claim 1, wherein the assembly comprises at least two nipples each having a distribution orifice of different cross-section.

10. The assembly according to claim 1, wherein in the closed position the nipple comes to rest on an internal surface of the capsule so that said surface closes off the distribution orifice.

11. The assembly according to claim 1, wherein the capsule comprises a sealing device that interrupts the communication between the distribution orifice and the interior of the receptacle when the assembly is in the closed position.

12. The assembly according to claim 1, wherein the receptacle terminates in an open neck on which the distribution head is mounted.

13. The assembly according to claim 1, wherein the receptacle terminates by an open neck in which the nipple is formed.

14. The assembly according to claim 1, wherein the receptacle comprises a deformable wall.

15. The assembly according to claim 1, wherein the receptacle contains a cosmetic product.

16. The assembly according to claim 4, wherein the membrane is obtained by bi-injection molding.

17. The assembly according to claim 5, wherein the membrane is fixed to the capsule by gluing, clamping, welding or riveting.

18. The assembly according to claim 12, wherein the distribution head is mounted by screwing or snap-fastening.

19. The assembly according to claim 1, wherein in the open position, the distribution orifice is located externally to the capsule at a distance not equal to zero from the plane.

20. An assembly for packaging and distribution of a liquid product comprising:

a receptacle intended to contain the product;

a distribution head fitted to the receptacle, the distribution head comprising at least one nipple with a distribution orifice able to communicate with the interior of the receptacle; and a capsule comprising at least one window having a flexible membrane with an outlet for dispensing the liquid product delimited by an edge extending at least in part in a plane;

the capsule being movable in relation to the nipple between a closed position in which the distribution orifice is at least partly opposite a portion of the capsule extending away from the window and an open position;

the capsule further comprising a sealing device that interrupts communication between the distribution orifice and the interior of the receptacle when the assembly is in the closed position.

21. The assembly according to claim 20, wherein the receptacle contains a cosmetic product.

22. The assembly according to claim 21, wherein the cosmetic product is a care product.

23. The assembly according to claim 21, wherein the cosmetic product is a hair product.

* * * * *